United States Patent [19]

Clark et al.

[11] Patent Number: 4,826,401

[45] Date of Patent: May 2, 1989

[54] CENTRIFUGAL PUMP

[75] Inventors: Eugene V. Clark, Northridge; George K. Sievers, Burbank, both of Calif.

[73] Assignee: TMT Research Development Inc., Burbank, Calif.

[21] Appl. No.: 279,828

[22] Filed: Jul. 2, 1981

[51] Int. Cl.[4] ..... F01D 25/24

[52] U.S. Cl. ..... 415/200; 415/206

[58] Field of Search ..... 415/212 R:212 A, 170, 415/174, 200, 206, 219 C; 416/241 R; 428/627; 148/16.6, 15.5, 6.35; 427/253, 255.4

[56] References Cited

U.S. PATENT DOCUMENTS

| | | | |
|---|---|---|---|
| 1,912,408 | 6/1933 | Schelhammer | 415/174 |
| 2,090,162 | 8/1937 | Tighe | 415/212 |
| 3,318,254 | 5/1967 | Palmberg et al. | 415/212 X |
| 3,637,320 | 1/1972 | Wakefield et al. | 415/200 |
| 3,764,373 | 10/1973 | Speirs et al. | 415/212 |
| 3,795,494 | 3/1974 | Hordon | 428/627 |
| 3,801,353 | 4/1974 | Brill-Edwards | 415/212 A |
| 3,842,921 | 10/1974 | Dill et al. | 148/15.5 X |
| 4,052,133 | 10/1977 | Yeater | 415/200 |
| 4,120,605 | 10/1978 | Hurst | 415/170 R |
| 4,202,654 | 5/1980 | Marlow | 415/170 R X |

FOREIGN PATENT DOCUMENTS

| | | | |
|---|---|---|---|
| 0009103 | 1/1977 | Japan | 415/200 |

OTHER PUBLICATIONS

Rengstoriff, G. W. P. Bever, M. B., Floe, C. F., Metal Progress, "The Carbonitriding Process of Case Hardening Steel", Nov. 1949, p. 651.

*Primary Examiner*—Harvey C. Hornsby
*Assistant Examiner*—Frankie L. Stinson
*Attorney, Agent, or Firm*—Louis J. Bachand

[57] ABSTRACT

Centrifugal pump adapted for pumping finely particulate slurries, comprising a steel housing having an inlet and an outlet and a volute therebetween, a motor mounted on the housing, and an impeller rotatably driven within the volute by the motor for pumping fluid through the housing along a flow path extending through the volute and between the inlet and outlet, the pump having surfaces conditioned against erosive wear along the flow path comprising iron carbide and iron boride formed in situ locally at pump steel surfaces subject to erosive wear.

1 Claim, 1 Drawing Sheet

CENTRIFUGAL PUMP

TECHNICAL FIELD

Figure 1:
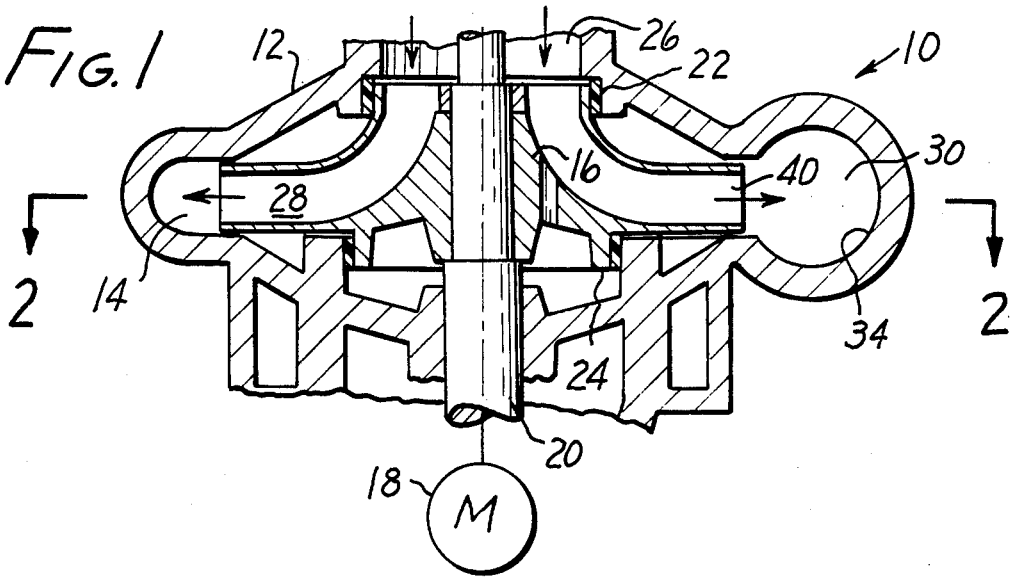

This invention has to do with centrifugal pumps, and more particularly is concerned with centrifugal pumps having increased erosion wear resistance, enabling longer life in severe usage applications such as the pumping of finely particulate slurries, e.g. coal slurries.

BACKGROUND ART

Centrifugal pumps are well known apparatus for the pumping of fluids such as gases, liquids and suspensions by the rotation of an impeller within a volute. The fluid to be pumped passes along a flow path extending from central inlet to the impeller, whence the fluid is expelled at a high rate centrifugally outward against a surrounding volute which opens to a horn leading to the pump outlet. Although all parts of the pump housing and components are subjected to wear, particularly when pumping finely particulate materials such as slurries or suspensions of coal, some parts by virtue of their location are particularly subject to erosive wear, i.e. wear caused not so much by large particle abrasion as by millions of minute contacts by the small particles which characterize fine particulate slurries. One area receiving considerable erosive contact is the cutwater, the sharply angled divider between the volute and the outlet horn; another area highly subject to erosion is on the wear rings on which the impeller turns; another is the impeller itself, the volute wall surrounding it, and those other areas where particle impact is at relatively higher velocities or frequency.

Typically, the pump housing and pump components are fabricated of steel, generally a carbon steel, and sometimes an iron base stainless steel. Such pumps can be improved in erosion wear resistance in accordance with the invention.

Importantly, the erosion resistance benefits conferred by the invention can be obtained locally in areas needing them, so that the entire pump need not be fabricated of exotic materials, nor coated entirely with a specialized coating which in fact is needed only here and there.

DESCRIPTION OF THE INVENTION

It is therefore an object of the invention to provide a centrifugal pump. It is another object to provide a centrifugal pump having locally improved wear resistance. Another object is the provision of a pump and pump components which are locally and specifically improved in erosion wear resistance, particularly in the areas of the cutwater, the impeller, the wear rings and the volute, with a view to longer, more reliable pump operation.

These and other objects of the invention to become apparent hereinafter are realized in a centrifugal pump adapted for pumping finely particulate slurries, comprising a steel housing having an inlet and an outlet and a volute therebetween, a motor mounted on the housing, and an impeller rotatably driven within the volute by the motor for pumping fluid through the housing along a flow path extending through the volute and between the inlet and outlet, the pump having surfaces conditioned against erosive wear along the flow path comprising iron carbide and iron boride formed in situ locally at pump steel surfaces subject to erosive wear.

In particular embodiments of the invention, the pump impeller is locally surface conditioned with iron carbide and iron boride; the volute includes a cutwater, and the cutwater is locally surface conditioned with the iron carbide and iron boride; the impeller is mounted in the housing with steel wear rings, and the wear rings are locally surface conditioned with the iron carbide and iron boride; and the steel housing comprises carbon steel or iron base stainless steel.

In further embodiments of the invention, there is provided the mentioned centrifugal pump in which the housing surfaces are coated with an erosion resistant coating comprising an inner layer of iron carbide and an outer layer of iron boride, and particularly wherein the outer layer of iron boride is iron carbide containing. Where carbonitriding is used in advance of the boronizing step, iron nitrides are also formed in the conditioned surface, along with the iron borides and iron carbides.

In accordance with the invention, the pump coating is from 0.4 to 0.8 millimeter in depth, overall, and the outer layer of iron boride is from 0.5 to 0.06 millimeter in depth.

Preferably, in the centrifugal pump according to the invention, the coating is formed by first diffusing carbon locally into the pump surfaces to be conditioned then after the carbon diffusion, diffusing boron from a diffusion pack at elevated temperatures and in the absence of oxygen, and thereafter quenching, to define an iron cabide layer outwardly relatively rich in iron boride as the coating.

THE DRAWINGS

Figure 2:
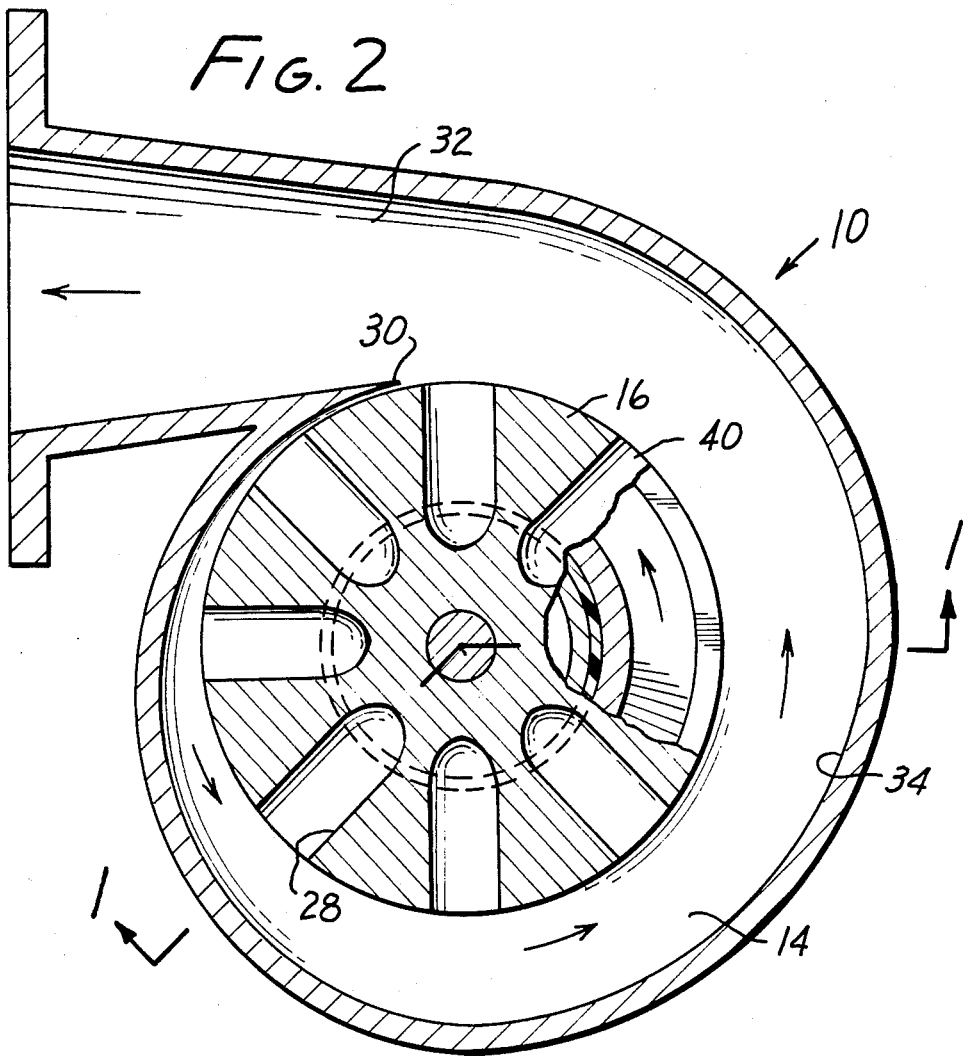

The invention will be further described as to an illustrative embodiment in conjunction with the attached drawings in which:

FIG. 1 is a view in vertical section of the present pump taken on line 1—1 in FIG. 2; and FIG. 2 is a view in horizontal section thereof, taken on line 2—2 in FIG. 1.

PREFERRED MODES

Turning now the drawings in detail, in FIG. 1 a typical centrifugal pump is shown at 10, and comprise a steel housing 12 defining a horizontally deposed volute 14 in which impeller 16 rotates counter-clockwise driven by motor 18 on shaft 20. Upper and lower wear rings 22, 24, journal the impeller 16 in the housing 12. In operation, liquid, gas or slurry to be pumped enters the pump 10 centrally at inlet 26, is thrown outwardly by impeller vanes 28 into volute 14 whence it is collected, carried spirally, divided by cutwater 30 and ejected at outlet horn 32.

When pumping finely particulate slurries, several locations along the flow path are subjected to extraordinary erosion. These include the inner and outer surfaces of the wear rings 22, 24 and the mating bearing surfaces of the impeller 16, the portions of the volute 14 impacted by the slurry e.g. areas 34, the cutwater 30, and of course the flow directing portion of the impeller 16, e.g. areas 40, are typical areas benefitting by the localized surface conditioning of the invention.

To so surface condition these several areas, all or some of them, the surface to be conditioned is delineated and preferably subjected to a two step diffusion as follows: The areas to be conditioned are carburized. Carbon from a carbon source such as a commercial carburizing compound, or methane, is diffused into the delineated areas by heating the area in contact with the carbon source, for a time, e.g. 5 hours and at a temperature, e.g. 1625° F., at which a subsurface carbon diffusion and formation of iron carbides to a suitable depth e.g. 0.4 to 0.8 millimeter, is realized. Since the pump housing and components being conditioned are steel parts, e.g. carbon steel or iron base stainless steel, the iron carbides are formed in the treated surface locally and responsive to the carbon diffusion thereinto. As mentioned where carbonitriding is employed, e.g. using sodium cyanide as the carbonitriding agent, iron nitrides are obtained in the conditioned surface, along with iron carbides and iron borides.

The area to be conditioned, now carburized, is then subjected to a boron diffusion under conventional conditions of time, temperature, and in an oxygen-free environment from a diffusion pack of per se known composition. For example, the part having the preformed iron carbide surface is immersed in a boronizing pack having typically the composition by weight:

Boron powder 2–10%;

Halogen activator sufficient to activate the pack;

Aluminum oxide, the balance.

The pack is heated at 1650° F. for eight hours or until a diffusion of boron to a depth of about 0.5 to 0.06 millimeter is realized, the boron combining with the iron present in the part surface to form iron borides, in the presence of the iron carbides. Because of the sequencing of diffusion steps, the outer portion of the coating is relatively rich in iron borides, and the inner portion thereof comparatively richer in iron carbides. The iron carbides are present in the outer predominantly iron boride layer as well, of course. The part is then quenched.

The result of the foregoing steps is a sequential iron carbide-iron boride modification of the part surface locally, corresponding to the portion or portions of the impeller, volute, cutwater, wear rings and so on locally subjected to diffusion. The portions to be treated are placed in the pack and the treatment carried out. The thus locally conditioned portions or portion areas show exceptional resistance to wear by erosion, caused by innumerable low energy impacts of fine particulates with the surface areas. This result is unexpected in centrifugal pump applications since there appears to be no known theoretical basis for predicting or explaining the improvement obtained. For example, conventional theories of support for a fragile coating as enhancing the performance of the coating would not seem to apply in the pump art where the impacts are minute, not heavy, and numerous, not infrequent. While not wishing to be bound to any particular theory, it is believed that the energy levels of the multitudinous impacts being low but continuous act to strip from the non-coated surface atoms needed to keep the surface from eroding, and the formation of the presently described coating blocks this action, effecting the noted improvements.

The role of the iron carbide in the present invention is not clear, since from a theoretical viewpoint its presence should not result in substantial improvement of the iron boride diffusion coating. But surprisingly, there is a remarkably beneficial effect on the erosion characteristic of the coating with the iron carbide preformation. For example the iron boride alone typically will last only 75% as long as the iron carbide/iron boride combination diffusion coating, in a like centrifugal pump application. The iron carbide alone shows no improvement over the steel surface alone. A synergistic result therefore is obtained which was not predictable from a consideration of the component materials, prior to experimentation.

The invention thus provides a centrifugal pump apparatus which operates longer, has fewer failures from erosion, and which is an improved pump product over this type of pump as previously known.

We claim:

1. Centrifugal pump adapted for pumping finely particulate slurries, comprising a steel housing having an inlet and an outlet and a volute therebetween, a motor mounted on said housing, and an impeller rotatably driven within said volute by said motor for pumping fluid through said housing along a flow path extending through said volute and between inlet and outlet, said pump having conditioned surfaces conditioned against erosive wear along said flow path comprising iron carbide, iron boride and iron nitride formed in situ locally at pump steel surfaces subject to erosive wear.

* * * * *